United States Patent [19]

Hetrick et al.

[11] 4,373,998

[45] Feb. 15, 1983

[54] ASCENSION PIPE HEAT SHIELD

[75] Inventors: Earl C. Hetrick, Natrona Heights; Donald T. Winter, Pittsburgh, both of Pa.

[73] Assignee: Koppers Company, Inc., Pittsburgh, Pa.

[21] Appl. No.: 315,066

[22] Filed: Oct. 26, 1981

[51] Int. Cl.[3] ..... C10B 27/06; C10B 41/08

[52] U.S. Cl. ..... 202/258; 98/46; 110/193; 122/160; 122/164; 122/504; 126/312; 165/129; 202/259; 202/260; 432/233

[58] Field of Search ..... 202/254–256, 202/259, 260, 270, 258; 165/55, 128, 129; 138/38, 114; 432/233, 238; 98/45–46; 126/312; 122/160, 164, 504; 110/193

[56] References Cited

U.S. PATENT DOCUMENTS

| | | | |
|---|---|---|---|
| 152,994 | 7/1874 | Hickley et al. | 98/46 |
| 3,087,408 | 4/1963 | Carr | 98/46 |
| 3,294,158 | 12/1966 | Baljet | 165/55 |
| 3,425,733 | 2/1969 | Hollingsworth | 202/254 |
| 3,580,815 | 5/1971 | Tucker | 202/254 |
| 3,804,721 | 4/1974 | Ginck | 202/256 |
| 3,858,609 | 1/1975 | Stanke et al. | 202/258 |
| 3,984,206 | 10/1976 | Winnen | 165/128 |
| 4,197,164 | 4/1980 | Pries | 202/256 |
| 4,329,976 | 5/1982 | Jackson | 126/312 |
| 4,346,660 | 8/1982 | McGill | 138/114 |

FOREIGN PATENT DOCUMENTS

| | | | |
|---|---|---|---|
| 121056 | 8/1927 | Switzerland | 165/128 |
| 536 | of 1857 | United Kingdom | 165/128 |
| 380685 | 5/1973 | U.S.S.R. | 202/254 |

*Primary Examiner*—Bradley Garris

*Attorney, Agent, or Firm*—Daniel J. Long; Herbert J. Zeh, Jr.; Oscar B. Brumback

[57] ABSTRACT

A heat shield for hot vertical pipes and, in particular, coke oven ascension pipes. This heat shield includes a lower, open-bottomed cylindrical housing section which peripherally encloses the pipe. Vertically projecting from this housing is an arcuate wall which is spaced from the pipe. The housing is internally partitioned into a warmer space adjacent the pipe and a cooler space remote from the pipe so that a heat dissipating upward draft is established in the housing and between the pipe and the vertical arcuate wall.

21 Claims, 4 Drawing Figures

ASCENSION PIPE HEAT SHIELD

BACKGROUND OF THE INVENTION

1. Field of the Invention

The present invention deals with heat shields for use in connection with hot pipes and, in particular, for use with coke oven ascension pipes.

2. Description of the Prior Art

The need to protect workmen from injury due to contact with hot pipes and discomfort from radiant heat eminating from such pipes is one that is common to a number of industries. Conventionally, such protection is provided by wrapping insulating material around the pipe or by completely or partially enclosing the pipe within a spaced peripheral shield so as to create an insulating air space adjacent the pipe. It is found, however, that in certain cases, any such method which has the effect of decreasing heat flow from the pipe, itself, may also have the effect of increasing the pipe's internal temperature to an unacceptable level. Furthermore, in certain situations, a vertical pipe may be positioned so that one of its sides faces a work area while its other side is adjacent a wall or is otherwise facing some area not frequented by workmen. In such cases, it may be desirable to provide relatively more protection on the side of the pipe facing the work space than on the side with which workmen are not likely to come into contact. The advantage of being able to position an area of maximum protection at a particular circumferential section of the pipe might not, however, be readily attainable when a uniform insulating layer is used on a pipe.

In the case of coke ovens, for example, a number of workmen are usually assigned to various duties on the battery top. Along the sides of the battery top, coke oven ascension pipes project upwardly to connect ducts in the roof with a collecting main that runs alongside the coke oven. The surface temperatures of these ascension pipes may reach 700° F., and in order to protect workers on the battery top from being accidentally burned by contact with these ascension pipes, as well as to decrease the radiant heat from the pipes to which these workers are exposed, it is important that an effective heat shield be provided on the side of the ascension pipe which faces inwardly toward the center of the battery top. The efficiency, on the other hand, of any heat shield on the side which faces outwardly over the side of the coke oven, is probably of less concern since workmen are probably less likely to directly touch or be exposed to radiant heat from that side of the ascension pipe.

Heat shields heretofore in use on coke oven ascension pipes have, in general, consisted of a single sheet of metal which is remotely connected to the ascension pipe, usually only on its side which faces inwardly toward the oven roof, so as to form an air space between the shield and the ascension pipe. A heat shield of this type is shown, for example, at numeral 14 in the drawings of U.S. Pat. No. 4,197,164. While such heat shields are known to provide some protection, it is found that at times they may reach temperatures which might be considered hazardous to nearby workmen. In view of these difficulities associated with ascension pipe heat shields heretofore in use, it has been suggested that ascension pipes be wrapped with a layer of external insulation so as to still further lower their external temperature. It is, however, believed that such a layer of insulation would retain heat to an extent so as to cause the internal temperature of the ascension pipes to rise to a point which might be detrimental to the pipe. It is, therefore, the object of the present invention to provide a heat shield which maximizes protection on the inner side of the ascension pipes and which, at the same time, dissipates heat so as to prevent pipe damage.

SUMMARY OF THE INVENTION

The present invention is a heat shield for hot vertical pipes such as coke oven ascension pipes. The pipe is peripherally enclosed by a lower cylindrical wall section so that a lower vertical air space is formed between the wall and the pipe. An upper arcuate wall section is connected, end to end, to the lower cylindrical wall section so as to form an upper vertical air space between itself and the ascension pipe. The lower vertical air space is outwardly blocked and inwardly partitioned into two separate vertical air channels. One channel, which is adjacent to the heated pipe, will contain warmer, faster moving air while the other channel, which is remote from the pipe, will contain cooler, slower moving air. Faster moving air and slower moving air from these channels converge in the upper vertical air space so as to establish an upward draft. By means of this draft, cooler exterior air is continuously drawn upwardly, first into the lower then into the upper vertical air space, until it is evacuated from the top of the upper arcuate wall section so as to dissipate heat from the inward side of the pipe.

BRIEF DESCRIPTION OF THE DRAWING

The present invention is further described in the accompanying drawings in which.

DETAILED DESCRIPTION

Figure 1:
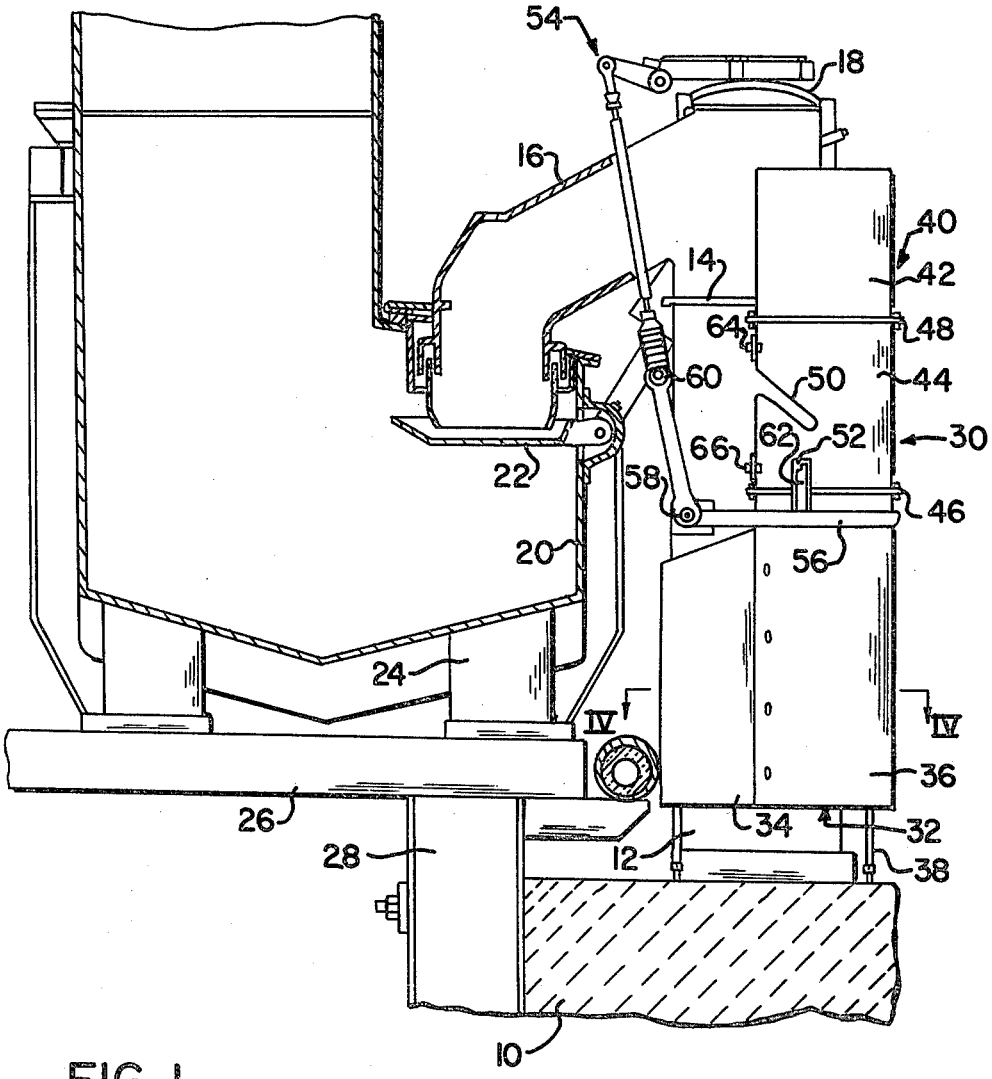
FIG. 1 is a front elevational view of the heat shield of the present invention mounted on a coke oven ascension pipe.
Figure 2:
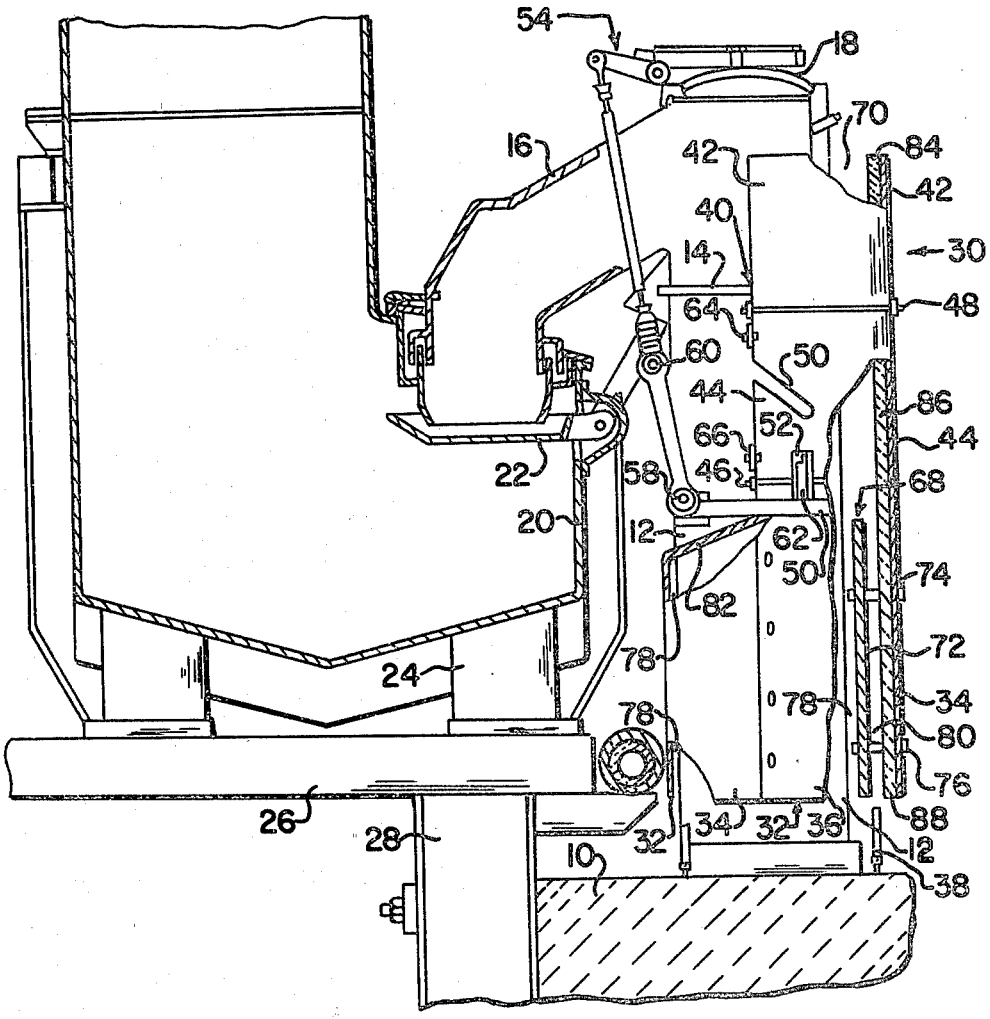
FIG. 2 is a cut-away view of the heat shield of the present invention similar to that shown in FIG. 1.

The heat shield of the present invention is shown as mounted on a coke oven ascension pipe in FIGS. 1 and 2. The coke oven is shown in fragment at numeral 10. The ascension pipe 12 projects vertically from a duct located on the roof and near the side of the battery top. The ascension pipe is connected at its upper end at flange 14 to gooseneck pipe 16. This gooseneck is equipped with a lid 18 which opens to facilitate the interior cleaning of the gooseneck and the ascension pipe. The gooseneck is also closeably connected at its terminal end to a collecting main 20. Damper pan 22 provides the means for closing and opening the gooseneck. The collecting main is mounted by supports such as leg 24 on platform 26, and this platform is, in turn, mounted on the buckstays as at 28. By means of the above described arrangement, volatile products of the coking process are conveyed from the coke oven through the ascension and the gooseneck pipes and to the collecting main. At various stages of the coking process, the ascension pipe will reach temperatures of approximately 700° F., and since workmen are typically required to be on the coke oven roof to perform various tasks when the ascension pipes are so heated it is necessary that an effective heat shield be provided to protect these workers from heat eminating from the pipes. It will also be noted that most of the duties performed by these workers will require them to be positioned between the ascension pipes and the center of the battery top, or, in other words, on the side of the ascension pipe opposite for the collecting main. Because personnel frequent this inward side of the ascension pipe, it will be apparent to those familiar with coke oven operations that the optimization of heat shielding on this side of the ascension pipe would be a desirable result.

Still referring to FIGS. 1 and 2, the heat shield of the present invention is shown generally at numeral 30. The heat shield 30 includes a lower generally cylindrical wall section, shown generally at 32, which is made up to two separate metal plates, namely an outward lower semicylindrical section 34 and an inward lower semicylindrical section 36. The lower cylindrical wall section 32 is remotely supported on the roof of coke oven by a plurality of legs as at 38. These legs may be adjustable in height so as to vary ambient air intake. Another major part of the heat shield 30 is the upper semicylindrical wall section 40 which is connected, end to end, to the lower cylindrical wall section. For ease of maintenance, the upper semicylindrical wall section 40 may be broken down into an upper section 42 and a medial section 44. The medial section 44 is connected to the inward lower semicylindrical section 36 at flange 46 and is connected to the upper section 42 at flange 48. The heat shield is also characterized by slots 50 and 52 which receive portions of the ascension pipe lid linkage shown generally at numeral 54. This linkage opens and closes the ascension pipe lid 18 and includes operating lever 56 which rotates in a vertical arc on pin 58 so as to move a trunion 60 from the position illustrated to one where the lid 18 is open and the trunion 60 is in engagement with slot 50. FIGS. 1 and 2 also show that slot 52 receives an operating lid step plate 62 which projects from operating lever 56 and which moves out of engagement with 62 when the operating lever is moved downwardly to open the lid 18. It will also be observed that the medial section 44 is fixed to the ascension pipe by means of brackets 64 and 66 and two other brackets (not shown) which are positioned on the opposite side of the ascension pipe.

Referring particularly to FIG. 2, it will be seen that a lower peripheral vertical air space, shown generally at 68, is formed between the ascension pipe 12 and the lower cylindrical wall section 32. Between the ascension pipe 12 and the upper semicylindrical wall section 40, there is also an upper inward vertical air space 70. From FIGS. 2 and 4, it will be seen that a semicylindrical interior wall 72 is attached at its lateral edges to the interior side of the outward lower semi-cylindrical section 34 and is retained thereto by means of bolts 74 and 76. This interior wall partitions the lower peripheral vertical air space into a warmer air channel 78, which is peripherally adjacent the ascension pipe 12, and a remote cooler air channel 80, which is formed between the interior wall 72 and the inward lower semicylindrical section 36. The lower cylindrical wall section 32 is also characterized by an outward closure plate 82 which projects toward the ascension pipe from the upper edge of the outward lower semicylindrical section 34. The effect of the closure plate 82 appears to be to cause air to flow from the outward portion of the warmer air channel 78, which underlies the outward lower semicylindrical section, into the inward position of the warmer air channel, which underlies the inward lower semicylindrical section 36, so as to increase the velocity of the fluid flow in that inward section. In any case, it has been found that the convergence of air from the warmer air channel 78 and the cooler air channel 80, above the interior wall 78, results in the establishment of an upwardly directed draft in both the lower peripheral vertical air space 68 and the upper inward vertical air space 70. Thus, relatively cool ambient air is continuously drawn first into the lower peripheral vertical air space 68 and then into the upper vertical air space 70 and finally is discharged at the top of the upper semicylindrical wall system. Heat is absorbed by this air on the inward surface of the ascension pipe and is dissipated from the top of the heat shield.

Figure 4:
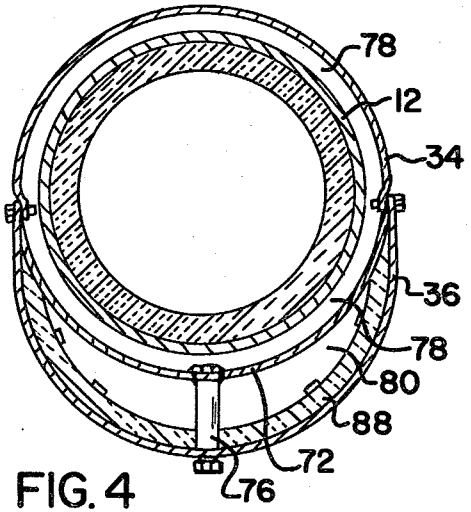
FIG. 4 is an enlarged cross-sectional view of the heat shield of the present invention as taken through line IV—IV in FIG. 1.
Figure 3:
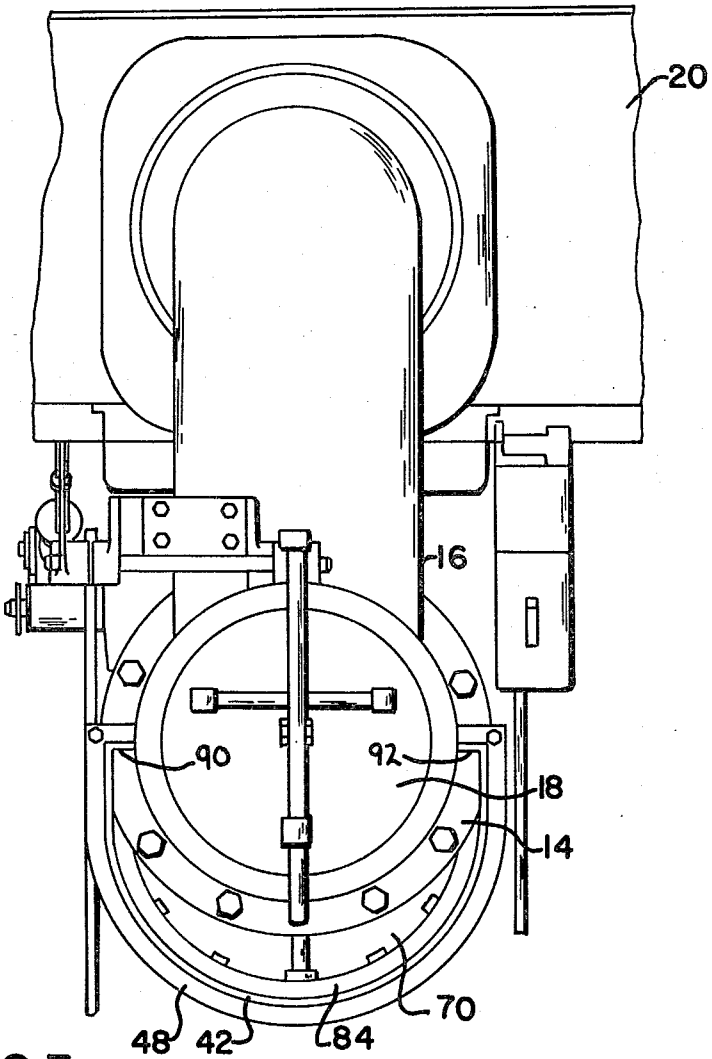
FIG. 3 is an enlarged plan view of the heat shield illustrated in FIG. 1.

From FIGS. 2 and 3 it will be seen that additional protection from the hot ascension pipe is provided by means of an upper insulating layer 84 which is interiorly attached to the upper section 42 of the upper semicylindrical wall section 40. FIG. 2 shows that a similar medial insulating layer 86 is also attached to the medial section 44 of upper semicylindrical wall section 40, and FIGS. 2 and 4 shows a lower insulation layer 88 which is interiorly attached on the inner side of the lower cylindrical wall section 32. Finally, it will be observed from FIG. 3 that the upper section 42 has at its lateral edges, two interiorly oriented flanges 90 and 92 which abut the gooseneck above and below flange 14 so as to better channelize the upward flow of air in the upper reaches of the upper vertical air space.

While not illustrated in the drawings, it may be possible to improve the performance of the heat shield of the present invention by providing a blower or other equivalent means for increasing the velocity of the upward air flow between the heat shield and the ascension pipe. While also not shown, it may also, under certain circumstances, be desirable to provide an exterior layer of insulation or an air enclosing sheet of metal on the unshielded outer side of the ascension pipe above the outward lower semicylindrical section 34.

It will thus be seen that there is provided an effective heat shield which is particularly useful for providing maximum protection over that part of an ascension pipe's periphery which presents the greatest danger to nearby workmen. Furthermore, it is believed that the surprising and unexpected occurrence of a stack effect between the heat shield of the present invention and the ascension pipe is responsible for a substantial reduction in measured temperatures on the exterior of the heat shield as compared with those which have been measured on the above described single-plate type heat shields heretofore used on ascension pipes. Those skilled in the art, however, will recognize that it will be possible to vary, to some extent, the configuration of the component wall sections of the heat shield described above and still obtain such a stack effect. It would, for example, be possible to substitute a wide variety of equivalent partitioned, bell-shaped housings for the lower cylindrical wall section described above. Such a housing would have an open lower end and be spaced from the structure on which it is mounted to allow entrance of ambient air to its interior. This equivalent housing would also have an upper central aperture to accommodate the heated ascension pipe, as well as a second inwardly adjacent aperture which would allow fluid communication between the interior of the housing and an upwardly projecting stack structure. This stack structure would convey upwardly moving air over an inward portion of the surface of the ascension pipe so as to remove heat from that surface. This cooled surface of the ascension pipe, itself, might, but would not necessarily, form a vertical surface of the stack.

Although the heat shield of the present invention has been described above in connection with a coke oven ascension pipe, it will be understood that it may be employed on any heated vertical or approximately vertical pipe. Accordingly, the present invention will be considered to encompass any such use of this heat shield. Furthermore, it is again noted that this heat shield is of particular usefulness where it is desired to maximize protection on one peripheral section or side of a heated vertical pipe. It is believed that in most applications of the present invention, that side of a heated vertical pipe which faces inwardly with respect to some larger room or other orienting structure will, as is the case with a coke over ascension pipe, be the side of the pipe on which heat shielding is desirably maximized. While it is recognized that such orientation may not always exist with respect to all pipes on which this heat shield may potentially be employed, the use, hereafter, of the terms "inner" and "inward" will, nevertheless, be understood to refer to that side of a pipe on which efficient heat shielding is of particular desirability or necessity.

Although the invention has been described with a certain degree of particularity, it is to be understood that the present disclosure has been made only as an example and that the scope of the invention is defined by what is hereafter claimed.

What is claimed is:

1. In combination, a heated vertical pipe and a device for providing enhanced heat shielding on an inward side of the heated vertical pipe which projects from a pipe supporting structure comprising:

(a) a generally cylindrical lower wall section spaced from and peripherally enclosing the pipe in generally concentric arrangement so as to form a peripheral lower vertical air space between itself and the pipe;

(b) means for remotely mounting said lower wall section above the pipe supporting structure as to establish lower fluid communication between said lower vertical air space and ambient air;

(c) an arcuate upper wall section aligned with and connected end to end to the cylindrical lower wall section and inwardly displaced from the pipe so as to form an upper vertical air space vertically contiguous with said lower vertical air space;

(d) a lower interior vertical wall section inwardly displaced from the pipe below said arcuate upper wall section so as to partition said peripheral lower vertical air space into a warmer air flow channel peripherally adjacent to the pipe and a cooler air flow channel remote from the pipe; and (e) closure means for outwardly blocking the warmer air flow channel, such that ambient air is drawn upwardly first through said lower vertical air space then through said upper vertical air space and is then upwardly discharged so as to continuously dissipate pipe heat.

2. The combination as defined in claim 1 wherein the lower wall section is comprised of inward and outward generally semicylindrical sections connected at their lateral edges.

3. The combination as defined in claim 2 wherein the outward generally semicylindrical section is at its upper edge flared upwardly and inwardly, and wherein the closure means for outwardly blocking the warmer air flow channel is a plate laterally projecting from said upper edge toward the pipe.

4. The combination as defined in claim 1 wherein the lower wall section is positioned relative to the pipe so that more than half of the lower vertical air space is adjacent the inward side of the pipe.

5. The combination as defined in claim 1 wherein the interior wall section is a vertical arcuate plate connected at its lateral edges to the lower wall section.

6. The combination as defined in claim 1 wherein the means for remotely mounting the lower wall section on the pipe supporting structure consists of a plurality of vertical legs downwardly depending from the lower wall section.

7. The combination as defined in claim 6 wherein the legs are adjustable in height so as to vary ambient air intake.

8. The combination as defined in claim 1 wherein the arcuate upper wall section is semicylindrical.

9. The combination as defined in claim 8 wherein flanges interiorly depend from the lateral edges of the arcuate upper wall section so as to abut the pipe.

10. The combination as defined in claim 8 wherein the arcuate upper wall section is comprised of two separate axially aligned arcuate wall sections connected end to end.

11. The combination as defined in claim 1 wherein a layer of insulating material is attached to the arcuate upper wall section and to the inward side of the generally cylindrical lower wall section.

12. The combination as defined in claim 1 wherein the heated vertical pipe is a coke oven ascension pipe.

13. The combination as defined in claim 12 wherein the coke oven ascension pipe is equipped with an ascension pipe lid and lifting linkage therefor an operating lever having a stop plate and rotating on a pin and a trunion interposed between two arms, one of which is connected to said pin, so that said trunion is moved inwardly in a vertical arc when said operating lever is moved downwardly in a vertical arc to lift said lid, and wherein an inwardly and a downwardly extending slot is provided in the arcuate upper wall section to receive said trunion and adjoining vertical slots are provided in the arcuate upper wall section and the lower wall section to receive said stop plate.

14. The combination as defined in claim 1 wherein the arcuate upper wall section is fixed to the pipe at its lateral edges by means of a plurality of brackets.

15. In combination, a heated vertical pipe and a device for providing enhanced heat shielding on an inward side of the heated vertical pipe which projects from a pipe supporting structure comprising:

(a) a bell-shaped housing open at its lower end and having a central aperture through which the pipe is interiorly received whereby the pipe and housing sealingly contact each other at least on the outward side of the central aperture, and having a second aperture inwardly displaced from said central aperture;

(b) means for remotely mounting the bell-shaped housing above the pipe supporting structure so as to establish lower, interior fluid communication with ambient air;

(c) a stack member vertically projecting from the bell-shaped housing at said second aperture; and (d) a vertical wall positioned below said stack member so as to interiorly partition the bell-shaped housing into a warmer air flow channel adjacent the pipe and a cooler air flow channel remote from the vertical pipe, such that ambient air is drawn upwardly first through the bell-shaped housing and then through the stack member and is then upwardly discharged so as to continuously dissipate pipe heat.

16. The combination as defined in claim 1 or 15 wherein a blower is provided to increase upward air flow velocity.

17. The combination as defined in claim 1 or 15 wherein a layer of insulating material is outwardly attached to the pipe to protect unshielded areas thereof.

18. The combination as defined in claim 15 wherein the means for remotely mounting the bell-shaped housing above the pipe supporting structure is a plurality of legs downwardly depending from the bell-shaped housing.

19. The combination as defined in claim 18 wherein the legs are adjustable in height so as to vary ambient air intake.

20. The combination as defined in claim 15 wherein the warmer air flow channel is peripherally adjacent the vertical pipe.

21. The combination as defined in claim 15 wherein the pipe is a coke oven ascension pipe.

* * * * *